US006112545A

United States Patent [19]

Stethem

[11] Patent Number: 6,112,545

[45] Date of Patent: Sep. 5, 2000

[54] SINGLE PIPE CLOSED LOOP REVERSE FLOW COOLING AND DEHUMIDIFICATION SYSTEM

[75] Inventor: Walter C. Stethem, Apollo Beach, Fla.

[73] Assignee: Taco, Inc., Cranston, R.I.

[21] Appl. No.: 09/302,619

[22] Filed: Apr. 30, 1999

[51] Int. Cl.[7] ..... F25D 17/02

[52] U.S. Cl. ..... 62/434; 285/41; 285/120.1; 285/122.1; 285/123.1; 285/123.15

[58] Field of Search ..... 62/434; 285/41, 285/120.1, 122.1, 123.1, 123.15

[56] References Cited

U.S. PATENT DOCUMENTS

| | | | |
|---|---|---|---|
| 3,017,202 | 1/1962 | Swaney | 285/41 |
| 3,425,485 | 2/1969 | Newton . | |
| 3,906,742 | 9/1975 | Newton | 62/332 |
| 4,718,478 | 1/1988 | Huber . | |
| 5,123,262 | 6/1992 | Laude-Bousquet | 62/434 |
| 5,203,384 | 4/1993 | Hansen | 141/59 |
| 5,449,204 | 9/1995 | Greene et al. | 285/133.1 |
| 5,466,995 | 11/1995 | Genga . | |
| 5,474,351 | 12/1995 | Ligh | 285/131 |
| 5,664,939 | 9/1997 | Giordani et al. . | |
| 5,732,981 | 3/1998 | Brucher et al. | 285/41 |
| 5,931,184 | 8/1999 | Armenia et al. | 137/312 |

*Primary Examiner*—William Doerrler
*Assistant Examiner*—Mark Shulman
*Attorney, Agent, or Firm*—Larson & Larson P.A.; James E. Larson

[57] ABSTRACT

Multiple coil fittings are connected in series to a closed loop single pipe circuit. Each coil fitting provides a paralleled chilled water flow to a fan coil servicing an enclosure. The coil fitting has a housing enclosing a first tubing for directing chilled water to the fan coil and a second tubing for directing return water to the pipe circuit. A baffle is mounted radially on the end of the second tubing proximal to the pipe circuit causing a portion of the chilled water in the pipe circuit to flow into the first pipe with the return water entering the pipe circuit below the baffle so there is no mixing of return water with the chilled water entering the first tubing regardless of the direction of flow in the pipe circuit. A humidistat mounted near the load coil farthest from the chiller sends a relative humidity signal to a diverter valve that changes the direction of chilled water flow in the pipe circuit.

11 Claims, 7 Drawing Sheets

SINGLE PIPE CLOSED LOOP REVERSE FLOW COOLING AND DEHUMIDIFICATION SYSTEM

BACKGROUND OF THE INVENTION

1. Field of the Invention

This invention relates to an air conditioning and dehumidification system. More particularly, it refers to a closed loop, single pipe, reverse fluid flow air conditioning and dehumidification system serving multiple enclosures.

2. Description of the Prior Art

In a hydronic system for cooling and dehumidifying a building, or a group of buildings, employing a single pipe supply arrangement, a progressive temperature change occurs to the entering water temperature (hereafter EWT) of subsequent loads connected along the single pipe circuit. Heretofore, this EWT change was avoided by adding a reverse return piping system. All load circuits are piped in parallel so that the flow of the first load fed will be the last flow returned to the chiller. In another two pipe direct return system, the first load fed is the first load returned. Each load circuit of either arrangement has to be balanced. Failure to establish the required balance causes low system temperature differences, high pump horsepower and inefficient chiller operations. Both forms of two pipe systems are labor intensive to design, install and commission.

In addition to the limitations discussed above, present day systems use two way control valves applied to each coil. This throttling of coil flow duplicates the same variable flow effect of three way valves. The high head loss creates a variable volume system. Variable speed system pumps are applied to reduce operating costs. Pump speed is adjusted to suit worst load conditions. All other loads continue to pay energy penalties.

Examples of pumps and zoning circular controllers used in prior art cooling system are described in U.S. Pat. Nos. 5,466,995 and 5,664,939, both incorporated herein by reference.

SUMMARY OF THE INVENTION

The present invention improves on the prior art by providing a single closed loop pipe reverse flow piping system with a modification in coil fittings to reduce the number of connections required between the coil runouts and the loop piping circuit. A unique pipe tee fitting is used to connect the supply and return branch piping of the terminal unit coils to the loop pipe circuit which contains chilled water from a chiller.

Coil fittings are connected in series to the pipe circuit with a tee fitting. A single coil fitting is provided for each fan coil servicing an enclosure. The coil fitting has a housing enclosing a first tubing carrying chilled water from the pipe circuit to the fan coil and a second tubing carrying return water from the fan coil to the pipe circuit. A baffle is radially mounted at an end of the second tubing proximal to the pipe circuit. The baffle is located at about the center portion of the pipe circuit so that chilled water passes from the pipe circuit above the baffle to enter the first tubing and exits the second tubing below the baffle. Therefore, there is no mixing of the incoming water with the return water regardless of the direction of flow of the water in the pipe circuit.

A humidistat located in a conditioned space monitors the relative humidity of the space served by the coil fed by the last fitting on the loop, the furthest from the chiller. The humidistat signals a diverter valve when the relative humidity approaches 50%, or its set point as determined by the building indoor air quality (IAQ) management control system, and causes the diverter valve to change the direction of water flow in the pipe circuit.

BRIEF DESCRIPTION OF THE DRAWINGS

This invention can be best understood by those having ordinary skill in the art by reference to the following detailed description when considered in conjunction with the accompanying drawings in which.

DETAILED DESCRIPTION OF THE INVENTION

Figure 1:
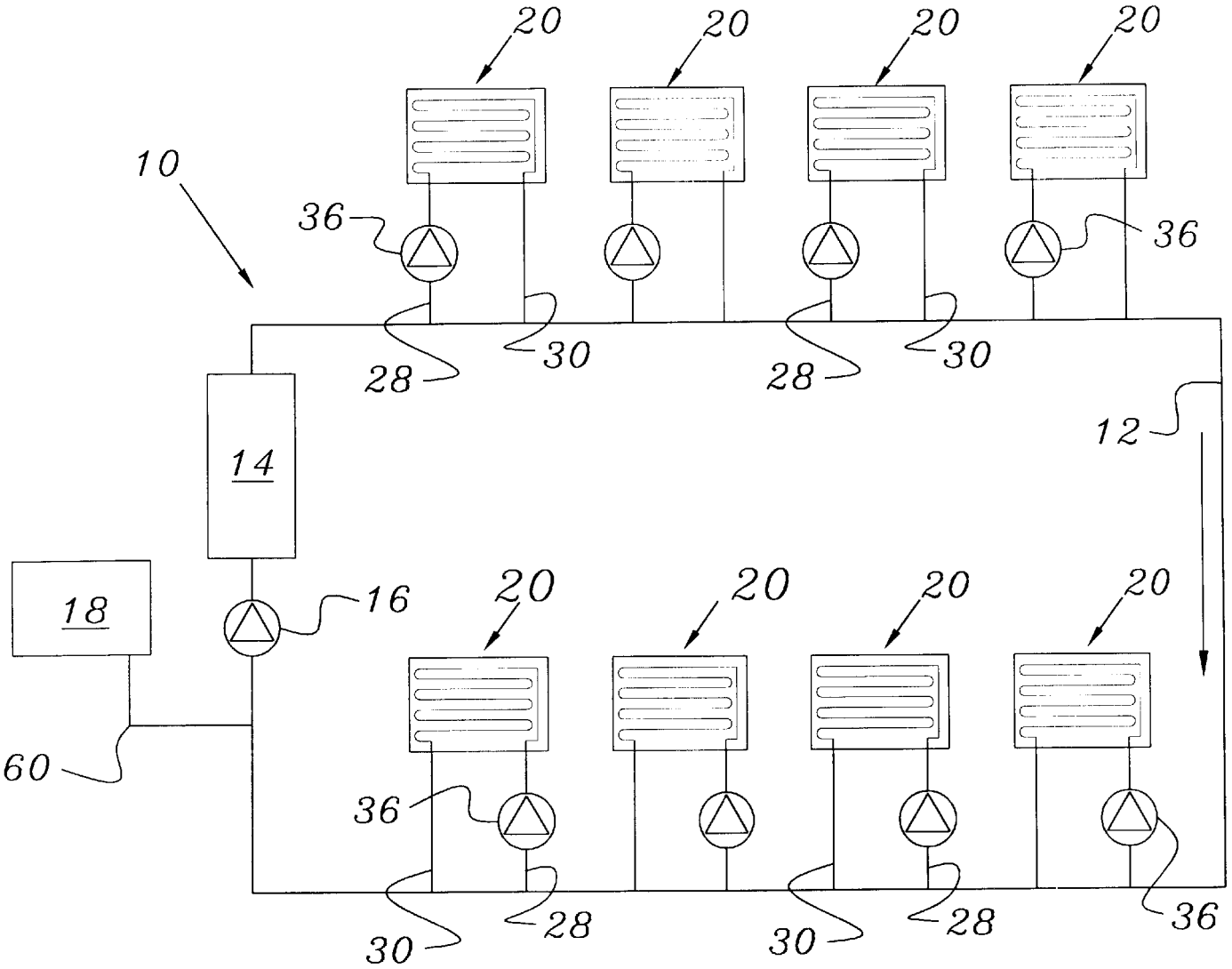
FIG. 1 is a diagrammatic view of the single loop pipe system of this invention.

Throughout the following detailed description, the same reference numerals refer to the same elements in all figures.

Referring to FIG. 1 the single loop single pipe hydronic system 10 has a single pipe circuit 12 with a chiller 14 and a pump 16 mounted in line with the pipe circuit 12. An expansion tank 18 attached out of line to the pipe circuit 12 receives excess air or water from the pipe circuit 12.

In the single pipe hydronic system shown in FIG. 1, the pump 16 has a low horesepower in the order of about one half required for a two pipe system with control values, which is all that is necessary to overcome the frictional forces generated by the pipe circuit. The system shown in FIG. 1 is serving eight enclosures 20, each of which contains a suitable heat transfer device such as a fan coil 22 providing cooling to each enclosure via the chilled water passing through the fan coil. The pipe circuit 12 transports the chilled water coming out of the chiller 14 at about 42° F. There are no control valves used in the system. The pipe circuit shown in FIG. 1 is illustrative of one that can be used in a residence with the piping circuit looping the area served.

Figure 2:
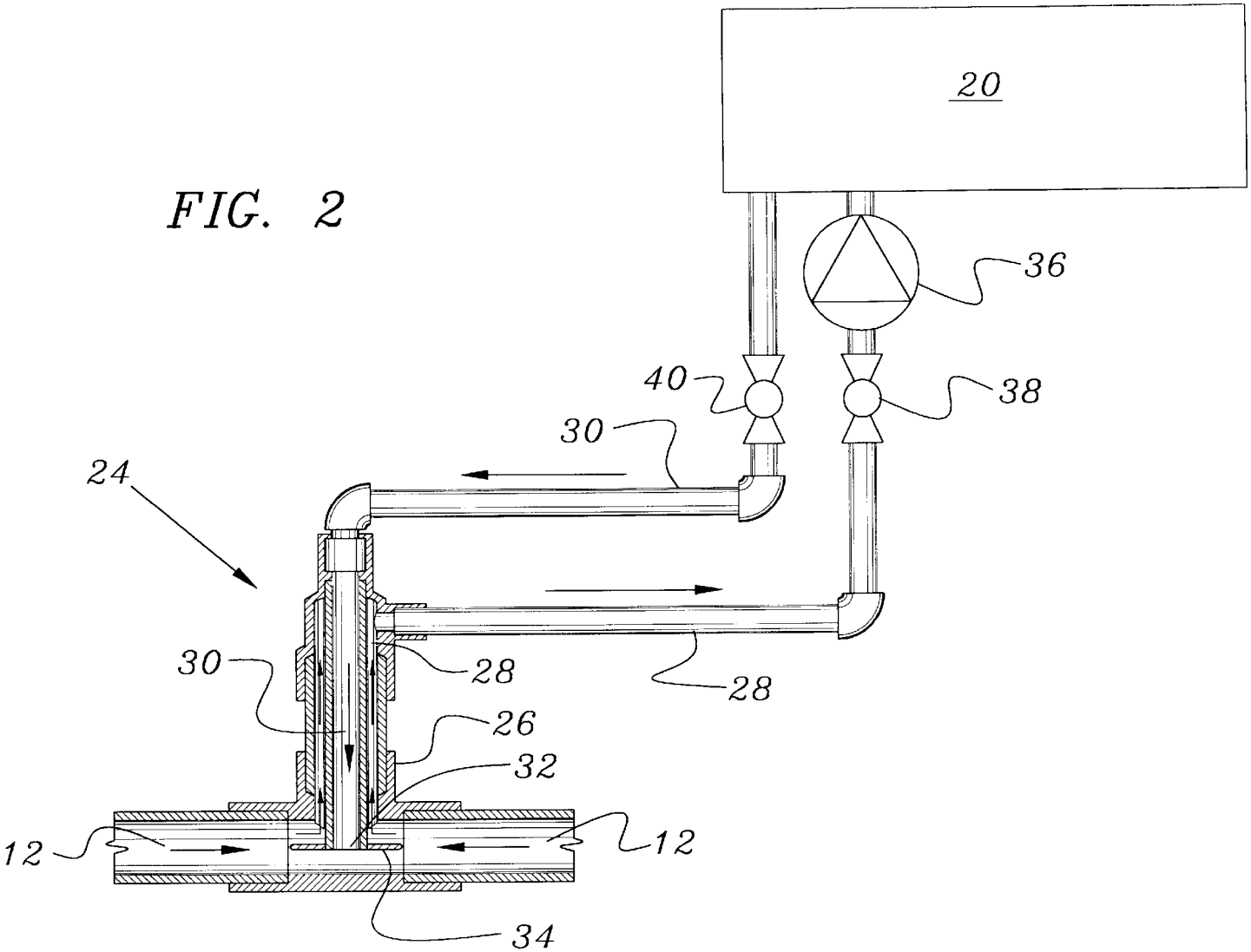
FIG. 2 is an elevational view partly in section showing the coil fitting and fan coil portion of the invention.
Figure 3:
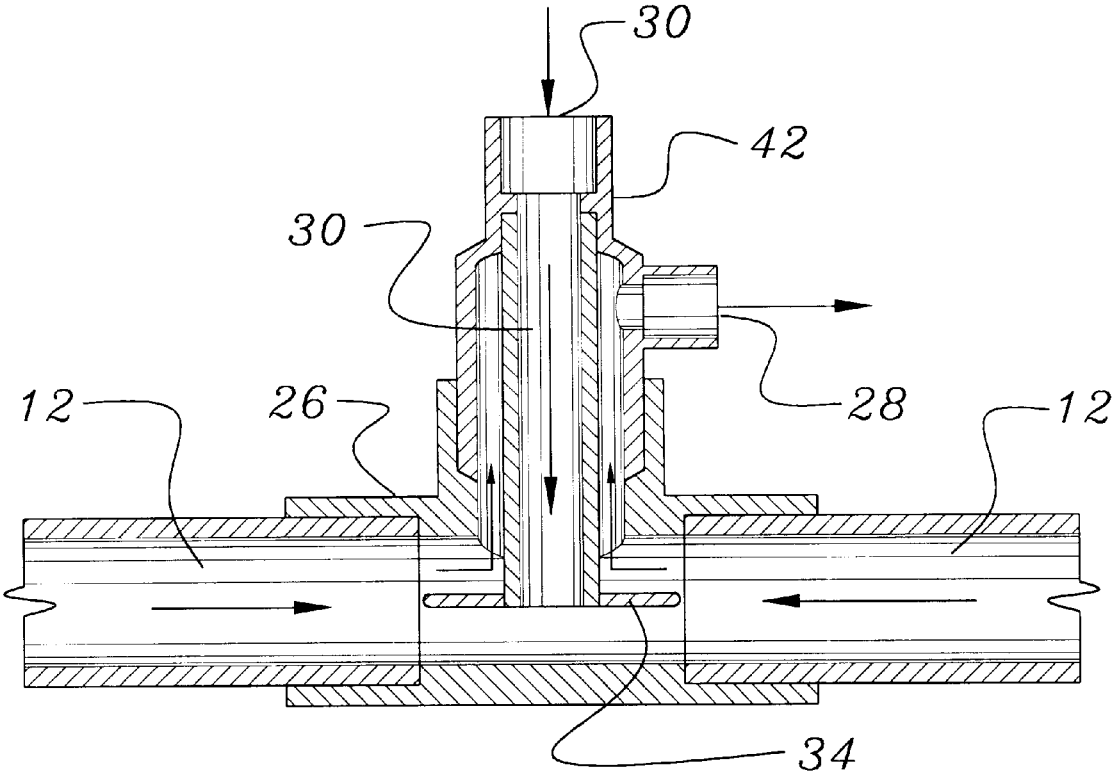
FIG. 3 is a sectional elevational view of the coil fitting mounted on the pipe circuit.

FIG. 2 shows the attachment of the coil fitting 24 to a pipe circuit 12 using a tee pipe fitting 26. Water flows inwardly from the pipe circuit 12 through incoming tubing 28 and flows through a valve 38 and a fan coil pump 36 to an enclosure 20 containing a fan coil 22. Water is returned from the fan coil through valve 40 and out through tubing 30 back into the pipe circuit 12. A baffle 34 is radially attached at an end of tubing 30 which is proximal to the pipe circuit 12. The baffle 34 allows incoming water to proceed into pipe 28 and return water deposited to the pipe circuit through pipe 30 below baffle 34 so that none of the incoming water mixes with the return water regardless of the flow direction in the pipe circuit 12.

Figure 4:
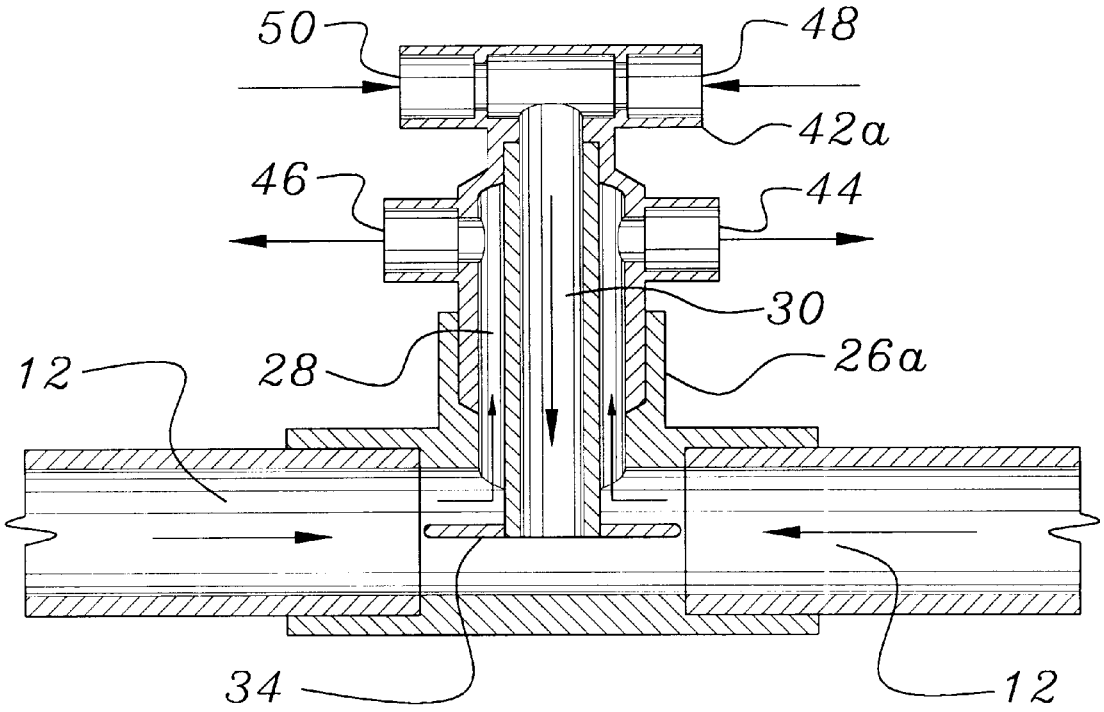
FIG. 4 is a sectional elevational view of an alternate coil fitting mounted on the pipe circuit.
Figure 5:
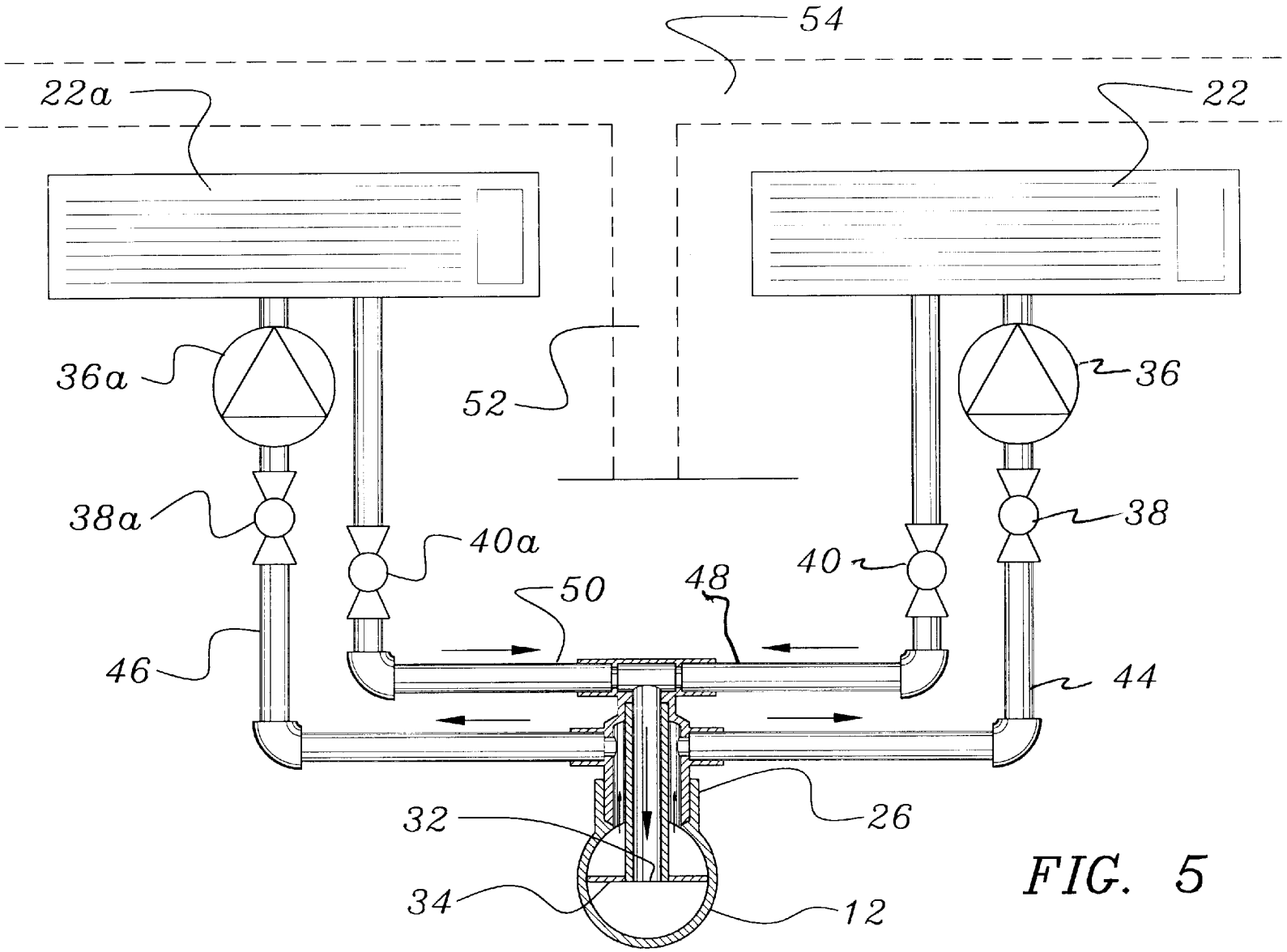
FIG. 5 is a partial sectional view of an alternate use of the coil fitting in a vertical riser system.

A single coil fitting can be used to service fan coils in adjacent enclosures as shown in FIGS. 4 and 5. The incoming chilled water through pipe circuit 12 enters the coil fitting 24 through the pipe 28, but flows out through either extension to pipe 28; namely, 44 or 46 to a fan coil 22 in one room or fan coil 22*a* in an adjacent room. A partition 52 separates the two rooms and an outside wall 54 defines an outer limit for the enclosure. The return water flows from fan coil 22 through pipe tubing 48 and valve 40 and from fan coil 22*a* through pipe tubing 50 through valve 40*a* and then out through tubing 30 to the pipe circuit 12.

Figure 8:
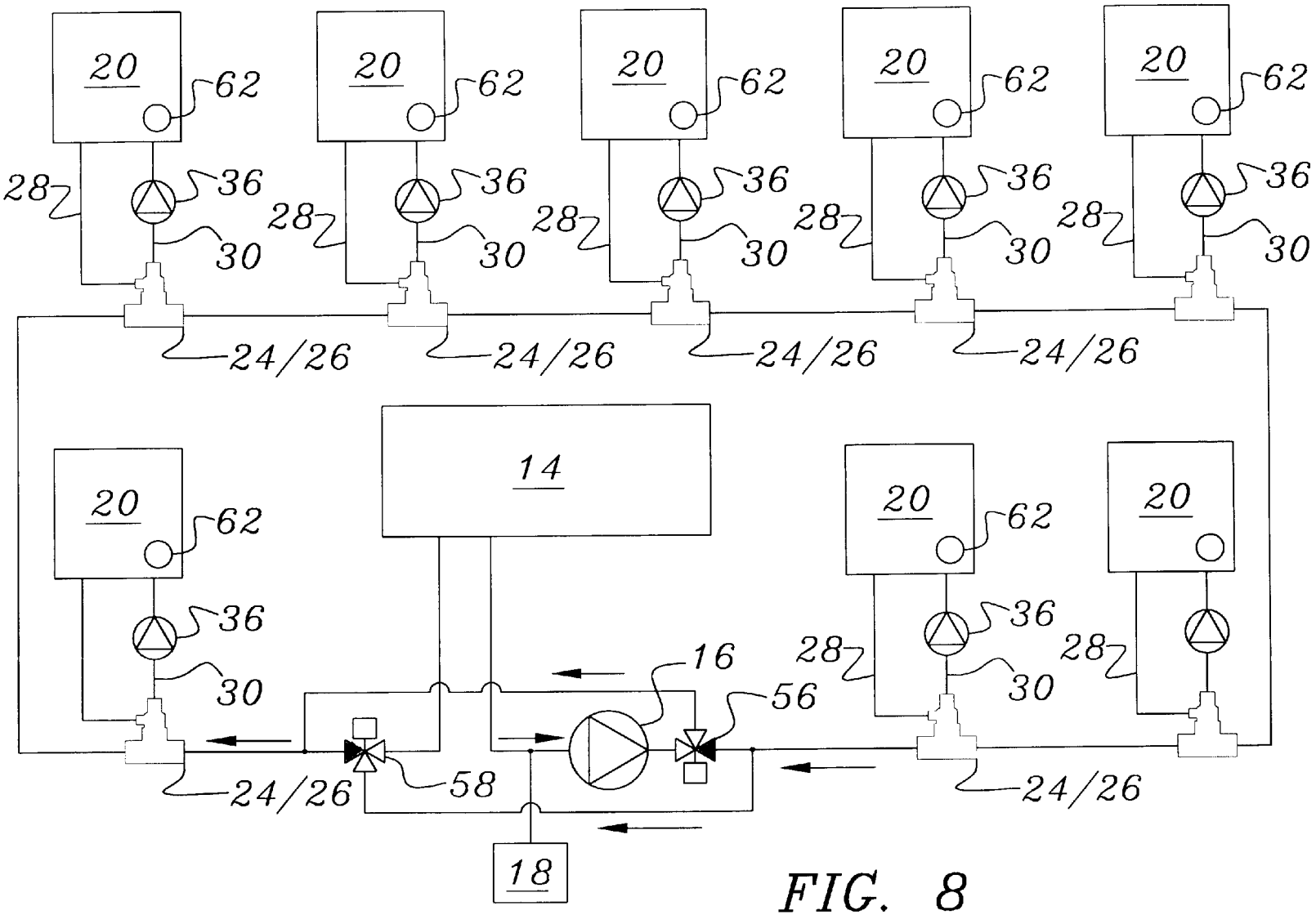
FIG. 8 is a diagrammatic view of the reverse flow system in the pipe circuit.
Figure 9:
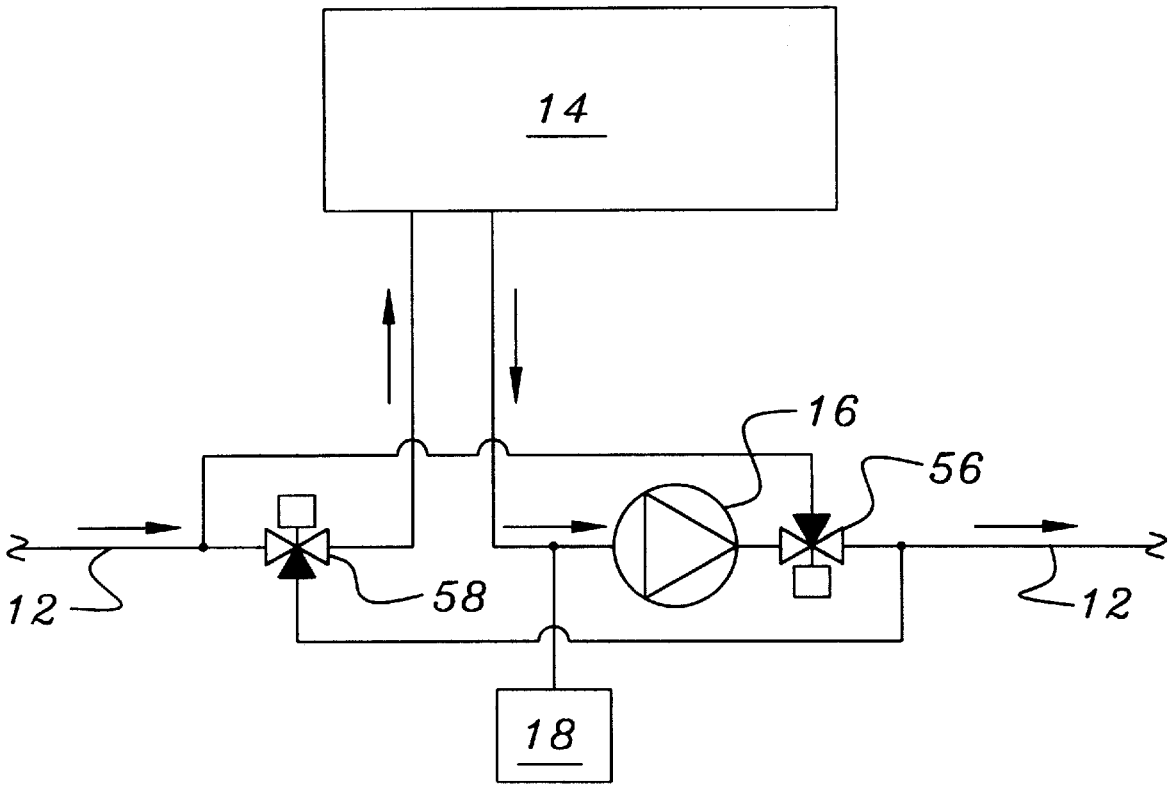
FIG. 9 is a diagrammatic view of the reversing mechanism used in the pipe circuit.
Figure 10:
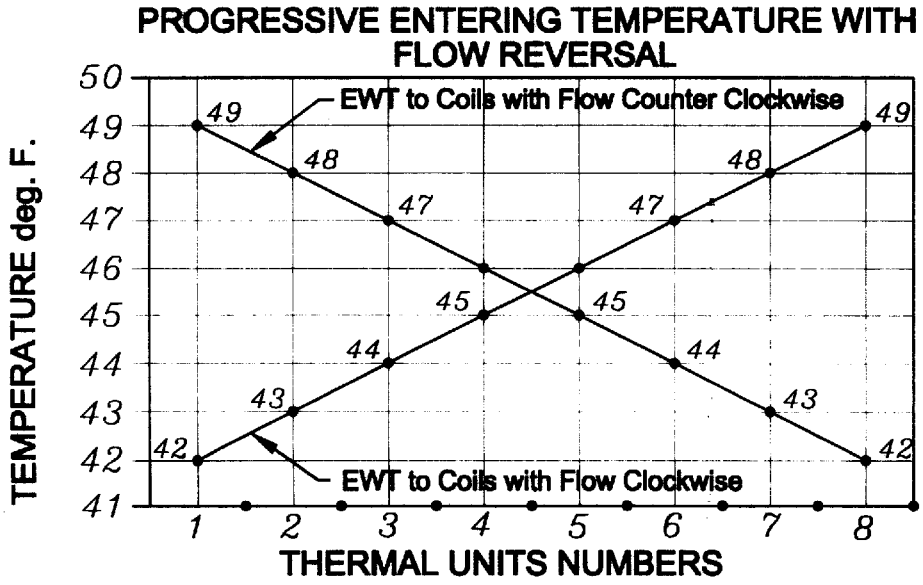
FIG. 10 is a chart showing the differences in temperature at various coil fittings depending on the direction of water flow.

As shown in FIGS. 8 and 9, a humidistat 62 is located in the building space served by each coil. When the relative humidity of the space served approaches 50% relative humidity, the direction of flow from the chiller is changed by a signal from the humidistat to the diverter valves 56 or 58. In this manner, the room temperatures and the relative humidity in the various enclosures are stabilized as shown in FIG. 10. A high relative humidity is obtained at about 49° F. A pipe 60 to the expansion tank 18 allows excess water or air pressure in the system to be relieved.

The tee fittings 26 and 26*a* can be made of black iron pipe, stainless steel, ductile iron, hard drawn copper or high density polyethylene. To suit large piping circuits found in multiple building and industrial applications the tee fittings 26 and 26*a* can be supplied with flanged connections. As an alternative the tee fitting 26 or 26*a* can be substituted with a saddle and U-bolt.

The loop piping circuit 12 can be made of any standard air conditioning piping and is sized to suit the total BTU requirements of the connected loads. The circuit pipe 12 size is chosen so that the velocity of the flow falls between three and six feet per second.

Figure 7:
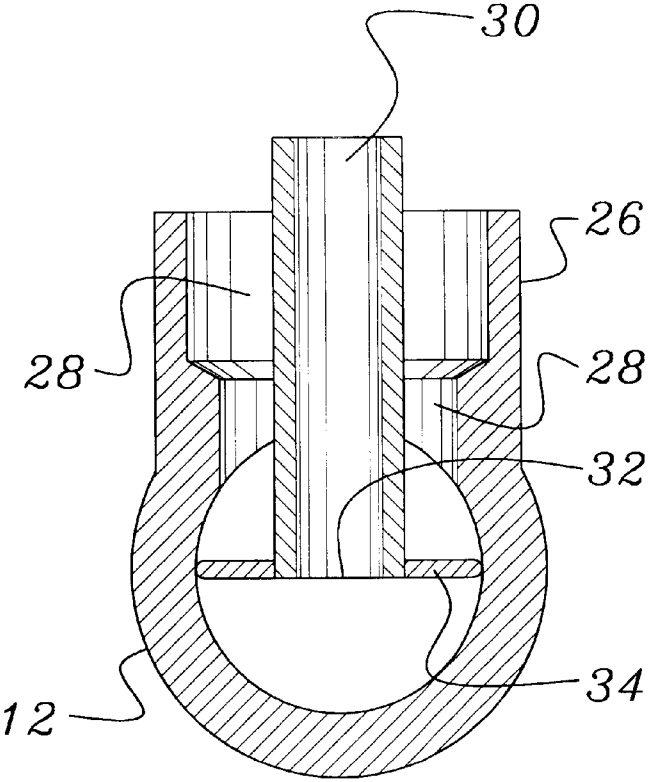
FIG. 7 is an end view in section of one end of the second tubing of the coil fitting in the pipe circuit with a radially attached baffle on the second tubing.
Figure 6:
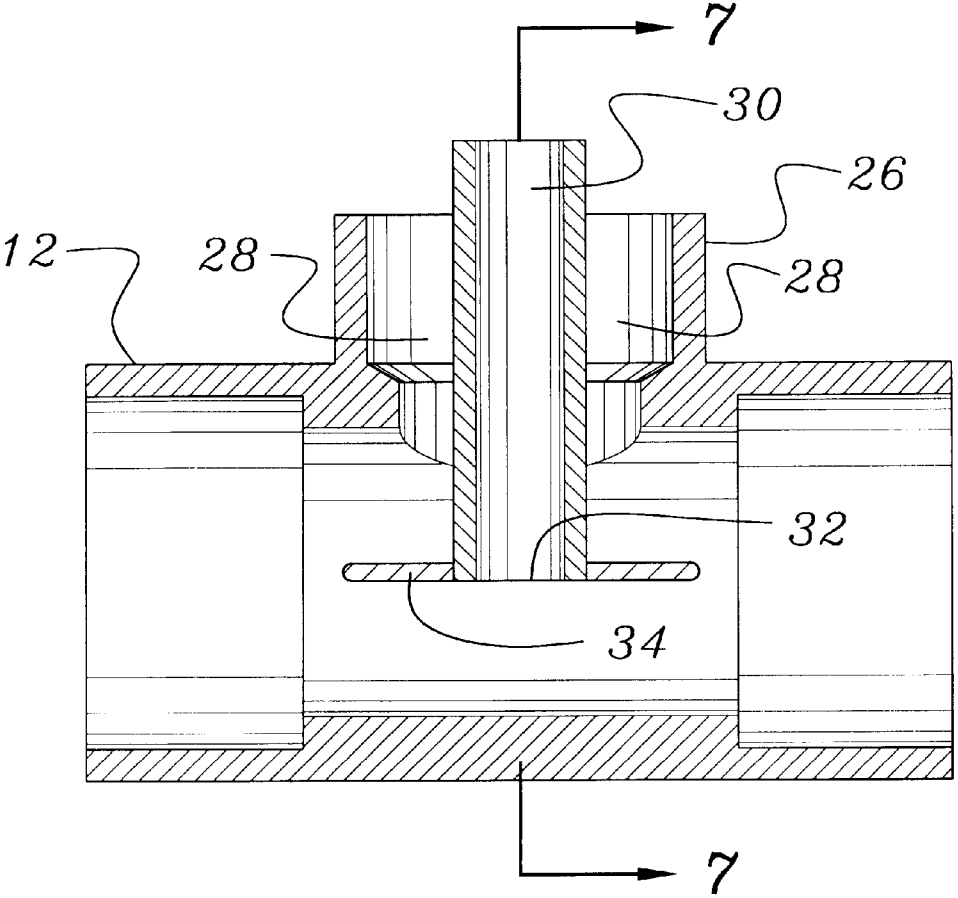
FIG. 6 is a sectional view of a bottom portion of the coil fitting connected to the pipe circuit.

The baffle 34 prevents mixing of fan coil return water with the pipe circuit 12 supply water and affecting the EWT to the fan coil being served. The baffle is positioned below the center line of the circuit piping as shown in FIG. 7 to equalize the upper and lower flow areas. The return tubing 30 has an end 32 attached to the baffle occupying space in the pipe circuit 12 above the baffle 34.

The housing 42 and 42*a* of the coil fitting 24 secures and supports the supply 28 and return tubing 30 and provides connection points for branch piping serving the fan coil.

The coil fitting 24 serves three main purposes. First, space is saved within a building structure and is especially important when utilized on vertical loop hydronic systems. Secondly, there is a 50% reduction on the number of connections between the fan coil 22 runouts and the piping circuit 12. Thirdly, the coil fittings make it possible for the supply and return flows to the connected fan coils to continue in the desired direction regardless of the flow direction in the pipe circuit 12. Humidity can be monitored anywhere in the building by a humidistat 62 as shown in FIG. 8 connected to a control system programmed to direct diverter valves 56 and 58 to change the flow direction so that a comfortable indoor atmosphere below the dew point is achieved to dehumidify the air of an enclosure as well as lower its ambient temperature.

The described single pipe reversal system provides comparable performance at low cost to the more costly two pipe direct return and reverse return system in the prior art.

Substantially equivalent functional elements can be substituted for the elements of the claimed system to obtain substantially the same results in substantially the same way.

What is claimed is:

1. A single pipe closed loop reverse flow system for use in cooling and dehumidifying multiple enclosures, each enclosure serviced through a suitable heat transfer device, the system comprising:

(a) a closed loop single pipe circuit connected in line to a chiller and a pump and connected out of line to an expansion tank;

(b) a single coil fitting connection to the pipe circuit to supply chilled water to the heat transfer device for each enclosure, the single coil fitting connected to the pipe circuit by a tee fitting, the coil fitting having a housing enclosing a first tubing carrying chilled water to the fan coil and a second tubing carrying return water from the fan coil to the pipe circuit, a baffle mounted at an end of the second tubing proximal to the pipe circuit causing water flowing in the pipe circuit to flow above the baffle to the first tubing and below the baffle to receive return water without mixing the return water with the flow to the first tubing regardless of the direction of water flow in the pipe circuit; and (c) a means to detect a prescribed high relative humidity in the space served by a coil fitting remote from the chiller and means for changing the flow direction in the piping circuit.

2. The single pipe closed loop reverse flow system of claim 1 wherein the water enters the pipe circuit from the chiller at a temperature satisfactory to cause condensation of water vapor.

3. The single pipe closed loop reverse flow system of claim 1 wherein the means to detect a prescribed high relative humidity is a humidistat.

4. The single pipe closed loop reverse flow system of claim 3 wherein the prescribed high relative humidity is about 49° F.

5. The single pipe closed loop reverse flow system of claim 1 wherein the reverse flow pump has a horsepower sufficient to recirculate the system flow rate through unobstructed piping.

6. The single pipe closed loop reverse flow system of claim 1 wherein the means for causing the flow direction in the piping circuit to reverse is a diverter valve acting in response to a signal from the humidistat.

7. The single pipe closed loop reverse flow system of claim 1 wherein there are 2–8 multiple enclosures and there are 2–8 coil fittings mounted in series to the pipe circuit corresponding to the number of multiple enclosures.

8. The single pipe closed loop reverse flow system of claim 7 wherein the multiple enclosures are in a single building.

9. The single pipe closed loop reverse flow system of claim 7 wherein the multiple enclosure are in separate buildings.

10. A single pipe closed loop reverse flow system for use in cooling and dehumidifying multiple enclosures, each enclosure serviced through a fan coil, the system comprising:

(a) a closed loop single pipe circuit connected in line to a chiller cooling water to a temperature suitable for cooling and a low horsepower pump and out of line to an expansion tank;

(b) multiple single coil fittings connected to the pipe circuit in series, each single coil fitting directing water flow to a fan coil, the coil fittings connected to the pipe circuit by a tee fitting, the coil fitting having a housing enclosing a first tubing carrying chilled water to the fan coil and a second tubing carrying return water from the fan coil to the pipe circuit, a baffle mounted radially at an end of the second tubing proximal to a center point of the pipe circuit causing water flowing in the pipe circuit to flow above the baffle to the first tubing and below the baffle to receive return water from the second tubing without mixing with the flow to the first tubing regardless of the direction of water flow in the pipe circuit;

(c) a humidistat measuring the relative humidity of a conditioned space; and (d) a diverter valve mounted in the piping circuit to change the direction of water flow in the piping circuit in response to a signal from the humidistat.

11. A method for controlling cooling temperature and humidity in a system for providing chilled water to multiple fan coils servicing corresponding multiple enclosures, the method comprising:

(a) providing a closed loop single pipe circuit connected in line to a chiller and a pump and connected out of line to an expansion tank;

(b) connecting a coil fitting to the pipe circuit for each fan coil using a tee fitting, the single coil fitting having a housing enclosing a first tubing conveying chilled water from the pipe circuit to the fan coil and a second tubing carrying return water from the fan coil to the pipe circuit;

(c) providing a baffle mounted radially at an end of the second tubing proximal to the pipe circuit so that water flowing in the pipe circuit flows above the baffle to the first tubing and below the baffle to receive return water without mixing with the flow to the first tubing regardless of the direction of water flow in the pipe circuit;

(d) providing a humidistat to detect relative humidity in the space served; and (e) providing a diverter valve to change the direction of water flow in the pipe circuit in response to a signal from the humidistat.

* * * * *